US005295225A

United States Patent [19]

Kane et al.

[11] Patent Number: 5,295,225

[45] Date of Patent: Mar. 15, 1994

[54] NOISE SIGNAL PREDICTION SYSTEM

[75] Inventors: Joji Kane, Nara; Akira Nohara, Nishinomiya, both of Japan

[73] Assignee: Matsushita Electric Industrial Co., Ltd., Osaka, Japan

[21] Appl. No.: 706,572

[22] Filed: May 28, 1991

[30] Foreign Application Priority Data

May 28, 1990 [JP] Japan ..... 2-138051
May 28, 1990 [JP] Japan ..... 2-138052

[51] Int. Cl.[5] ..... G10L 9/00
[52] U.S. Cl. ..... 395/2.35; 395/2.62
[58] Field of Search ..... 381/29-53; 395/2.35, 2.62

[56] References Cited

U.S. PATENT DOCUMENTS 4,628,529 12/1986 Borth et al. ..... 381/94

FOREIGN PATENT DOCUMENTS

WO87/00366 1/1987 PCT Int'l Appl. .
WO87/04294 7/1987 PCT Int'l Appl. .

OTHER PUBLICATIONS

"Cepstrum Pitch Determination", A. Michael Noll, The Journal of Acoustical Society of America, Aug. 1966, pp. 293-309.

"Suppression of Acoustic Noise in Speech Using Spectral Subtraction", Steven F. Boll, Member, IEEE Transactions On Acoustics, Speech, and Signal Processing, vol. ASSP-27, Apr. 1979.

"Adaptive Processing with Feature Extraction to Enhance the Intelligibility of Noise-Corrupted Speech", Conway et al., IECON '87, pp. 997-1002.

*Primary Examiner*—Michael R. Fleming
*Assistant Examiner*—Michelle Doerrler
*Attorney, Agent, or Firm*—Wenderoth, Lind & Ponack

[57] ABSTRACT

A noise signal prediction system includes a signal detector for receiving a mixed signal having a voice signal and a background noise signal and for detecting the presence and absence of the voice signal contained in the mixed signal. A noise level detector is provided for detecting an actual noise level at each sampling cycle during the absence of the voice signal. A storing circuit stores the noise levels for a predetermined number of past sampling cycles. A predicting circuit predicts a noise level of a next sampling cycle based on the stored noise levels in the storing circuit. The storing circuit receiving and stores the actual noise levels during the absence of the voice signal, but stores the predicted noise levels during the presence of the voice signal.

4 Claims, 11 Drawing Sheets

NOISE SIGNAL PREDICTION SYSTEM

BACKGROUND OF THE INVENTION

1. Field of the Invention

The present invention relates to a noise prediction system for estimating or predicting the noise signal contained in a data signal such as a voice signal.

2. Description of the Prior Art

Conventionally, there have been developed techniques capable of predicting the noise signal contained in a data signal, such as in a voice signal, and removing the same so as to obtain a voice signal of an excellent quality. The important point in these techniques is an prediction method for predicting the noise signal contained in the data signal.

For example, there is known a method for analyzing the voice signal containing a white noise signal by a Fourier transformation. The white noise signal is continuously present, whereas the voice signal is present intermittently. The white noise signal is detected during the absence of the voice signal, and the noise signal data is obtained immediately before the leading edge of the voice signal, and the noise signal data is stored and is used for counterbalancing the white noise signal present during the presence of the voice signal. According to this method, the noise prediction for the noise signal contained in the data portion is effected based on the noise information immediately before the voice signal portion.

However, according to this prediction method, since the noise signal data immediately before the voice signal is used, the prediction of the noise signal in the voice signal areas is likely to be coarse and inaccurate.

SUMMARY OF THE INVENTION

The object of the present invention is therefore to provide a noise signal prediction system which solves these problems.

The present invention has been developed with a view to substantially solving the above described disadvantages and has for its essential object to provide an improved electrophotographic imaging device.

In order to achieve the aforementioned objective, a noise signal prediction system according to the present invention comprises: a signal detection means for receiving a mixed signal consisting of a wanted signal and a background noise signal and for detecting the presence and absence of said wanted signal contained in said mixed signal; and a noise prediction means for predicting a noise signal in said mixed signal by evaluating noise signals obtained in a predetermined past time.

Furthermore, according to a preferred embodiment, a noise signal prediction system comprises: a signal detection means for receiving a mixed signal consisting of a wanted signal and as background noise signal and for detecting the presence and absence of said wanted signal contained in said mixed signal; a noise level detecting means for detecting an actual noise level at each sampling cycle during the absence of said wanted signal; a storing means for storing the noise levels for a predetermined number of past sampling cycles, said storing means receiving and storing said actual noise levels during the absence of said wanted signal; and a predicting means for predicting a noise level of a next sampling cycle based on said stored noise levels in said storing means; wherein said storing means stores said predicted noise levels during the presence of said wanted signal.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
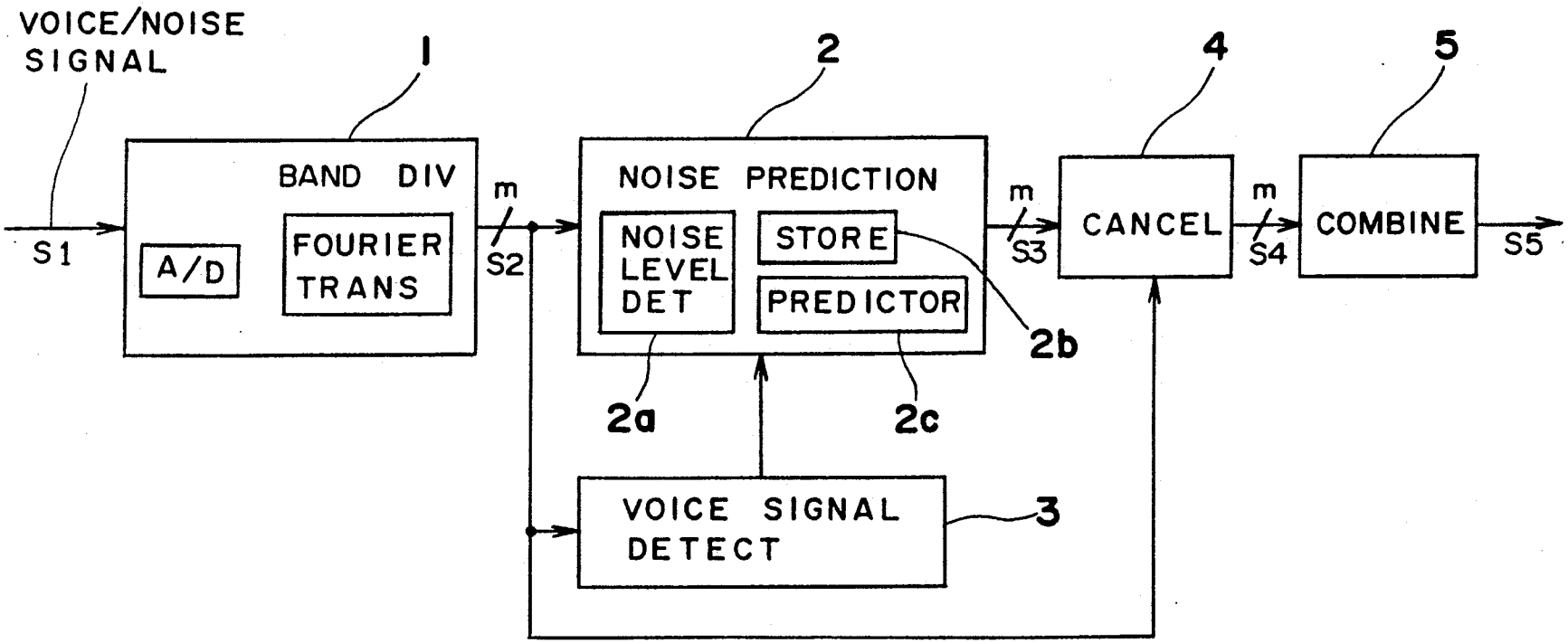
FIG. 1 is a block diagram showing a first embodiment of the noise signal prediction system according to the present invention.

Referring to FIG. 1, a block diagram of a signal processing device utilizing a noise prediction system according to the present invention is shown.

In FIG. 1, a band dividing circuit 1 is provided for A/D conversion and for dividing the A/D converted input voice signal with accompanying noise signal (noise mixed with a voice input signal) into a plurality of, such as m, frequency ranges by way of a Fourier transformation at a predetermined sampling rate. The divided signals are transmitted through m-channel parallel lines. The noise signal is present continuously as in the white noise signal, and the voice signal appears intermittently. Instead of the voice signal, any other data signal may be used.

A voice signal detection circuit 3 receives the noise mixed with a voice input signal and detects the voice signal portion within the background noise signal and produces a signal indicative of the absence/presence of the voice signal. For example, circuit 3 is a cepstrum analyzing circuit which detects the portion wherein the voice signal is present by the cepstrum analysis as will be described later.

A noise prediction circuit 2 includes a noise level detector 2*a* for detecting the level of the actual noise signal during every sampling cycle but only during the absence of the voice signal, a storing circuit 2*b* for storing noise levels obtained during a predetermined number of sampling cycles before the present sampling cycle, and a noise level predictor 2*c* for predicting the noise level of the next sampling cycle based on the stored noise signals. The prediction of the noise signal level of the next sampling cycle is carried out by evaluating the stored noise signals, for example by taking an average of the stored noise signals. In this case, the predictor 2*c* is an averaging circuit.

Thus in the noise prediction circuit 2, during absence of the voice signal as detected by the signal detector 3, the noise signal level of the next sampling cycle is predicted using the stored noise signals. The predicted noise signal level is sent to a cancellation circuit 4. After that, the predicted noise signal is replaced with the actually detected noise signal and is stored in the storing circuit. Thus, during the absence of the voice signal, the storing circuit 2*b* stores the actually detected noise signal during every sampling cycle, and the prediction is effected in the predictor 2*c* by the actually detected noise signal.

On the other hand, during the presence of the voice signal as detected by signal detector 3, the noise signal level of the next sampling cycle is predicted in the same manner as described above, and is sent to the cancellation circuit 4. After that, since there is no actually detected noise signal at this moment, the predicted noise signal is stored in the storing circuit 2*b* together with other noise signals obtained previously. Thus, during the presence of the voice signal, the actual noise signals of the past data as stored in the storing circuit 2*b* are sequentially replaced by the predicted noise signals.

The cancellation circuit 4 is provided to cancel the noise signal in the voice signal by subtracting the predicted noise signal from the Fourier transformed noise mixed with a voice input signal, and is formed, for example, by a subtractor.

It is to be noted that each of circuits 2, 3 and 4 is provided to process m-channels separately.

A combining circuit 5 is provided after the cancellation circuit 4 for combining or synthesizing the m-channel signals to produce a voice signal with the noise signals being canceled not only during those periods in which the voice signal is absent, but also during those periods in which the voice signal is present. The combing circuit 5 is formed, for example, by an inverse Fourier transformation circuit and a D/A converter.

Figures 9A, 9B, 9C, 9D, 9E:
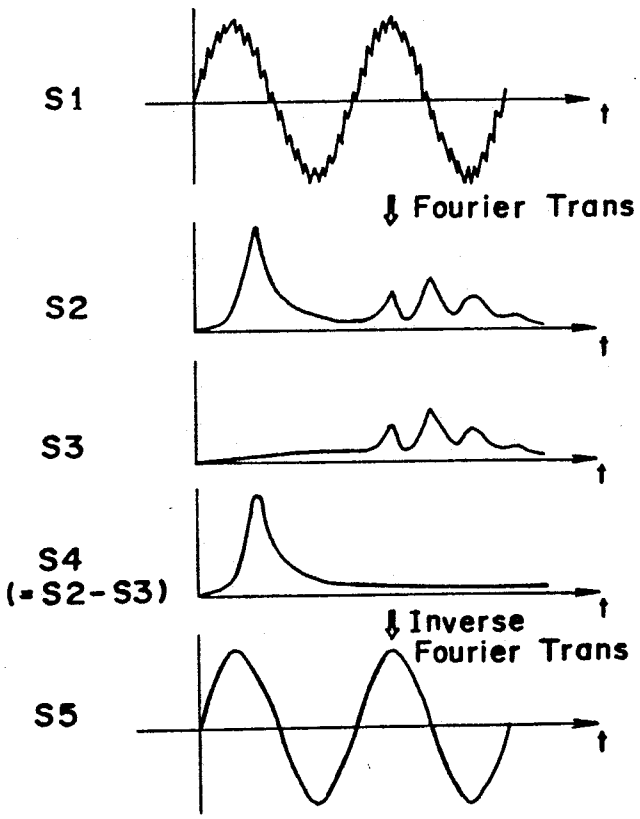
FIGS. 9*a*, 9*b*, 9*c*, 9*d* and 9*e* show graphs illustrating the processing in a preferred embodiment of the present invention.

In FIG. 1, signal s1 is a noise mixed with a voice input signal (FIG. 9*a*) and signal s2 is a signal obtained by fourier transforming the input signal s1 (FIG. 9*b*). Signal s3 is a predicted noise signal (FIG. 9*c*) and signal s4 is a signal obtained by canceling the noise signal (FIG. 9*d*).

It is to be noted that in FIG. 1, only one signal s2 is shown for the sake of brevity, but there are m signals s2 for m-channels, respectively. Similarly, there are m signals s3 and m signals s4.

Signal s5 is a signal obtained by inverse Fourier transforming the noise canceled signal (FIG. 9*e*).

In the present embodiment, as shown in FIG. 1, the noise mixed with a voice input signal s1 is divided into m-channel signals s2 by the band dividing circuit 1. In each channel, the voice signal period is detected by the signal detection circuit 3. Then, the noise prediction circuit 2 predicts the noise signal level of the next sampling cycle such that, during the absence of the voice signal wherein only the noise signal is present, the predicted noise signal of the next sampling cycle is obtained by evaluating, such as by averaging, the noise signals collected in the predetermined number of past sampling cycles, and then, the predicted noise signal level of the next sampling cycle is outputted to the cancellation circuit 4 and, at the same time, is replaced with the actually sampled noise signal level which is stored in the noise prediction circuit 2 for use in the next prediction. On the other hand, during the presence of the voice signal, the predicted noise signal of the next sampling cycle is stored in the noise prediction circuit 2 without any replacement. The presence and absence of the voice signal is detected by the signal detection circuit 3. The cancellation circuit 4 subtracts the output predicted noise signal from the noise mixed voice input signal, so as to obtain a noiseless signal. The cancellation is carried out not only during the presence of the voice signal, but also during the absence of the voice signal. The cancellation may be carried out by adding the inverse of the predicted noise signal to the signal s2. The signals s4 from which the noise signals are removed by the cancellation circuit 4 are combined by the combining circuit 5 so as to produce a noiseless signal s5.

Figure 2:
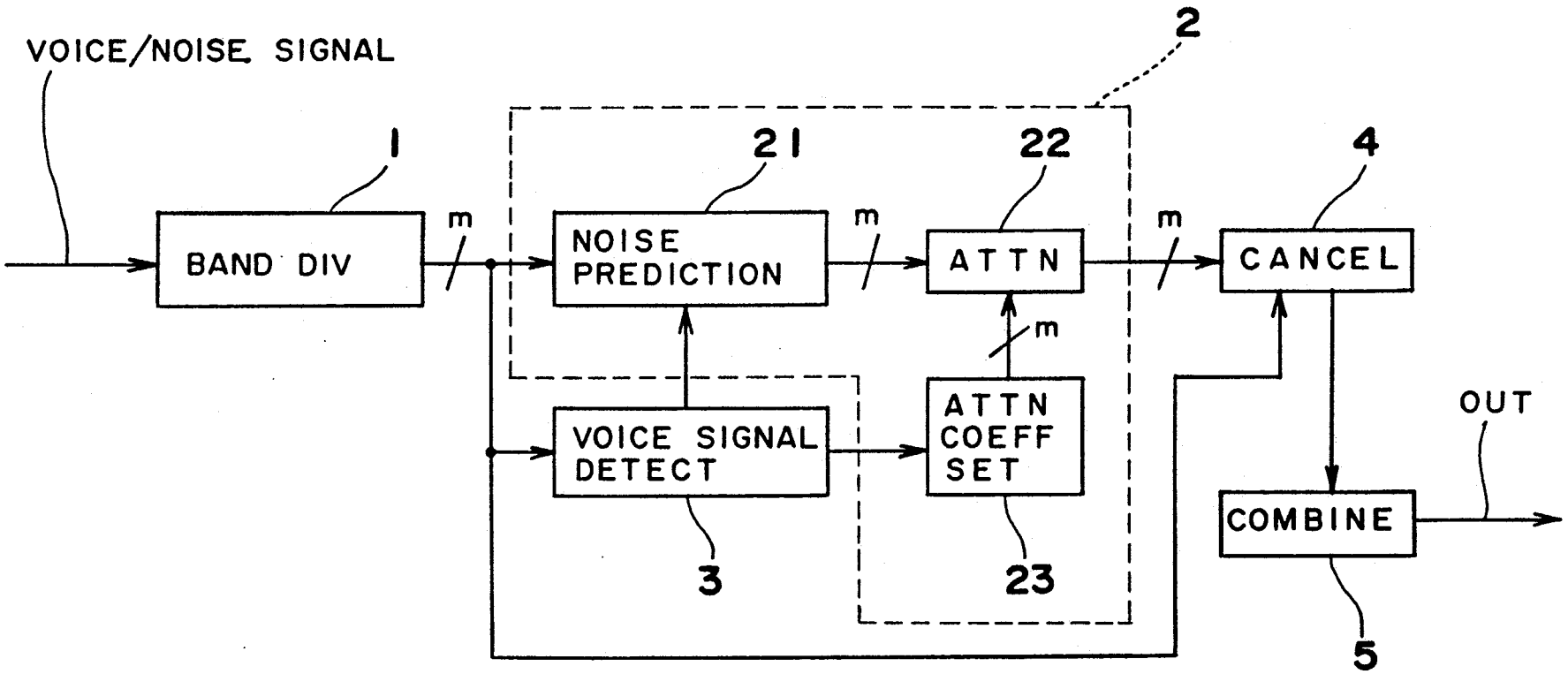
FIG. 2 is a block diagram showing a detail of the circuit shown in FIG. 1.

Referring to FIG. 2, a preferred embodiment is shown. In addition to predicting the noise signal, the noise prediction circuit 2 attenuates the predicted noise signal, so as to reduce the predicted noise signal level. For example, as shown in FIG. 2, the noise prediction circuit 2 includes an attenuation coefficient setting circuit 23 and an attenuator 22.

An attenuation coefficient setting circuit 23 is provided for receiving the signal indicative of the absence/presence of the voice signal from the voice signal detection circuit 3 and for producing an attenuation coefficient signal in relation to the signal from circuit 3. An attenuator 22 is connected to the noise prediction circuit 21 for attenuating the predicted noise signal in accordance with the attenuation coefficient set by the attenuation coefficient setting circuit 23.

When the signal from circuit 3 indicates that the voice signal is absent, the attenuation coefficient setting circuit 23 produces an attenuation coefficient equal to "1" so that there will be no substantial attenuation of the predicted noise signal. However, when the voice signal is present, the attenuation coefficient setting circuit 23 produces an attenuation coefficient not equal to "1" so that there will be attenuation of the predicted noise signal level. The attenuation coefficient during the presence of the voice signal may be set to a constant value or may be varied according to a predetermined pattern, as will be described later in connection with FIGS. 8*a* to 8*d*.

Figure 7:
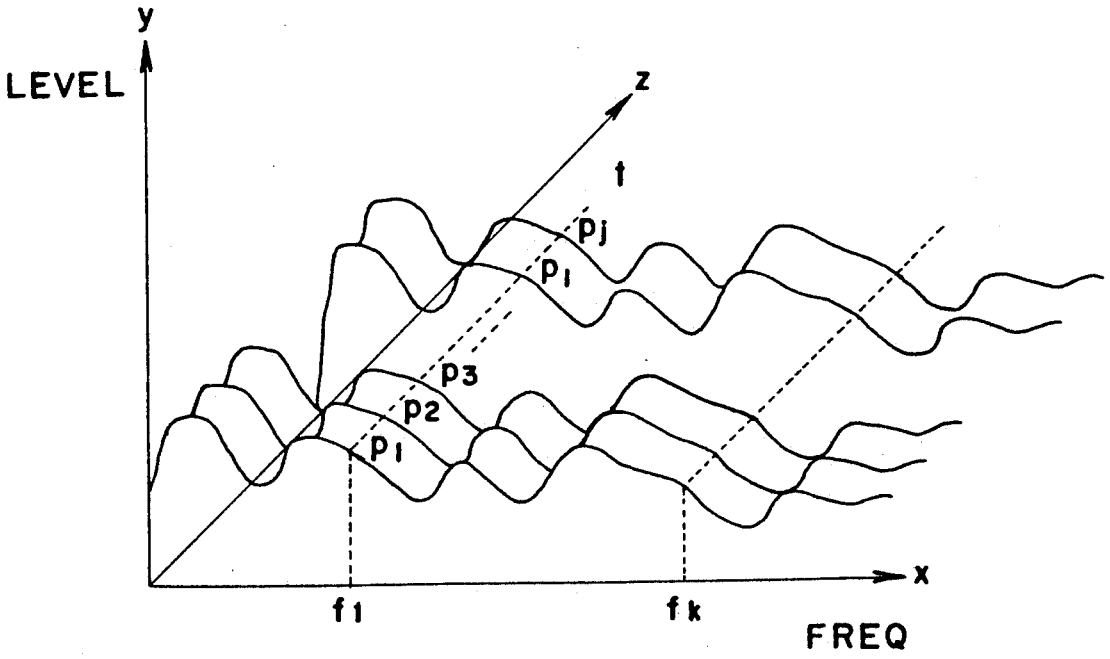
FIG. 7 is a graph for explaining the general noise prediction method.

The noise predictor 21 receives the noise mixed with a voice input signal that has been transformed to a Fourier series, as shown in FIG. 7, in which the X-axis represents frequency, the Y-axis represents noise level and the Z-axis represents time. Noise signal data p1–pi during the predetermined past time is collected in the noise predictor 21, and is evaluated, such as taking an average of p1–pi, to predict noise signal data pj in the next sampling cycle. Preferably, such a noise signal prediction is carried out for each of the m-channels of the divided bands.

Figure 6A:
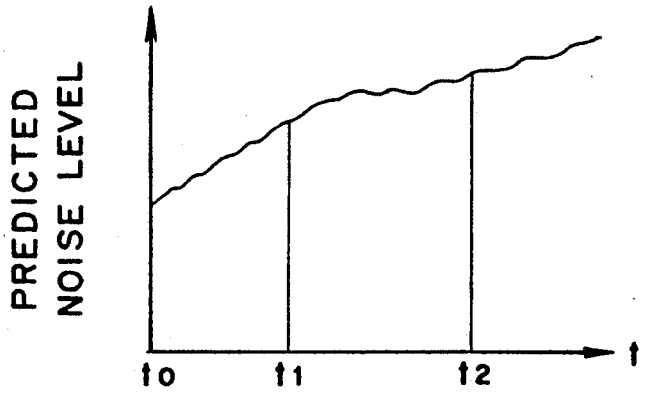
FIGS. 6*a* and 6*b* show graphs illustrating the calculated noise predict value and the output noise predict value according to a preferred embodiment of the present invention.

In FIG. 6a the predicted noise level without any attenuation is shown. When it is assumed that a voice signal is present between times t1 and t2, the attenuation coefficient setting circuit 23 sets an attenuation coefficient during the voice signal portion (t1–t2) as detected by the signal detection circuit 3. Thus, during the period t1–t2, the predicted noise level is attenuated in attenuator 22 controlled by a predetermined coefficient, which in this case is gradually increased according to an exponential curve. Therefore, in the example shown in FIG. 6b, the attenuation coefficient setting circuit 23 is previously programmed to follow a pattern with an exponential curve, such as by using a suitable table, to produce attenuation coefficient that varies exponentially as shown in FIG. 8a.

Figures 8A, 8B, 8C, 8D:
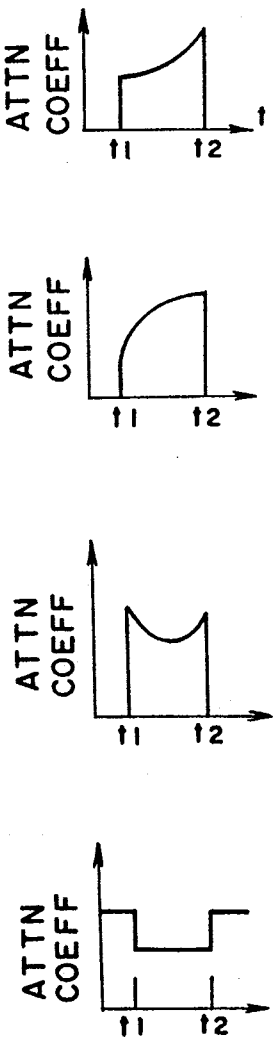
FIGS. 8*a*, 8*b*, 8*c* and 8*d* show graphs illustrating attenuation coefficients in a preferred embodiment of the present invention.

Although it is preferable to use the attenuation coefficient pattern that increases gradually as shown in FIG. 8a, other attenuation coefficient patterns may be used. For example, a hyperbola pattern shown in FIG. 8b, a downward circular arc pattern shown in FIG. 8c, or a stepped line pattern shown in FIG. 8d may be used.

Figure 6B:
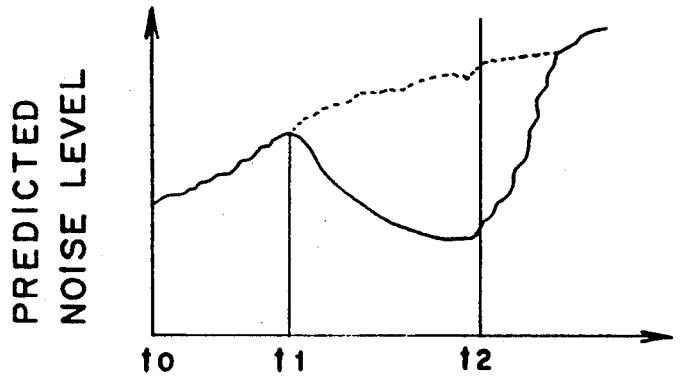

The attenuator 22 attenuates the predicted noise signal during the voice signal period (t1–t2) as produced from the noise predictor 21. More specifically, the predicted noise signal level at time t1 is multiplied by the attenuation coefficient at the time t1. After time t1, the corresponding attenuation coefficient is multiplied similarly. Accordingly, in the case of using an attenuation coefficient of an exponential curve pattern, the predicted noise signal levels at the input and the output of the attenuator 22 at time t1 are nearly the same. Thereafter, the output of attenuator 22 gradually becomes smaller than the input thereof, as shown in FIG. 6b. Then, the predicted noise signal level during the presence of the voice signal becomes relatively small, so that even when the predicted noise signal level at circuit 21 is rough, there is no fear of losing too much of the voice signal data during the period t1–t2. Thus, a clarity of the voice signal is ensured even after the cancellation of the noise signal at the cancellation circuit 4.

Since the predicted noise signal level is obtained by using the noise data collected during a predetermined period, or predetermined number of sampling cycles, before the present sampling cycle, it is possible to predict the noise signal level of the present sampling cycle with a high accuracy. During the absence of the voice signal, the predicted noise signal level of the present sampling cycle is replaced by an actually detected noise signal level which is used for predicting the noise signal level of the next sampling cycle. In this manner, the prediction of the noise signal level can be carried out with a high accuracy. On the other hand, during the presence of the voice signal as detected by the signal detector 3, the noise signal level is predicted in the same manner as the above, and the predicted noise signal level is used, together with the noise signals obtained previously, for predicting the noise signal level of the next sampling cycle. Thus, according to the present invention, since the prediction of the noise signal level during the presence of the voice signal is not as accurate as those obtained during the absence of the voice signal, the predicted noise signal level is attenuated by attenuation circuit 22 controlled by attenuation coefficient setting circuit 23. Thus, even if the prediction of the noise signal level during the presence of the voice signal increasingly deviates from the actual noise signal level, the predicted noise signal level is attenuated gradually. Thus, such a deviation will not adversely affect the cancellation of the wanted data such as the voice signal in the cancellation circuit 4.

Furthermore, although the prediction of the noise signal level at the end of the voice signal presence period would be smaller than the actual noise signal level, the prediction of the noise signal level after the voice signal would soon be approximately the same as the actual noise signal level, because the prediction after the voice signal is carried out again by the actually obtained noise signal level.

Furthermore, besides the case where the predicted noise signal level increases with the time as shown in FIG. 6a, there may be a case where the predicted noise signal level decreases with time. In any case the predicted noise signal can be attenuated similarly. In the case of using the other attenuation coefficient patterns shown in FIGS. 8a–8d, the predicted noise signal can be similarly attenuated by a predetermined amount.

According to the present invention, since the predicted noise signal of high accuracy is used during the absence of the voice signal, and the predicted noise signal of an appropriate level is used during the presence of the voice signal, an excellent quality signal can be obtained with no inaccurate cancellation of noise being effected during the presence of the voice signal.

Furthermore, it is possible to eliminate the dividing circuit 1 and combining circuit 4. In this case, the input signal is detected in analog form, without dividing it into bands.

Figure 3:
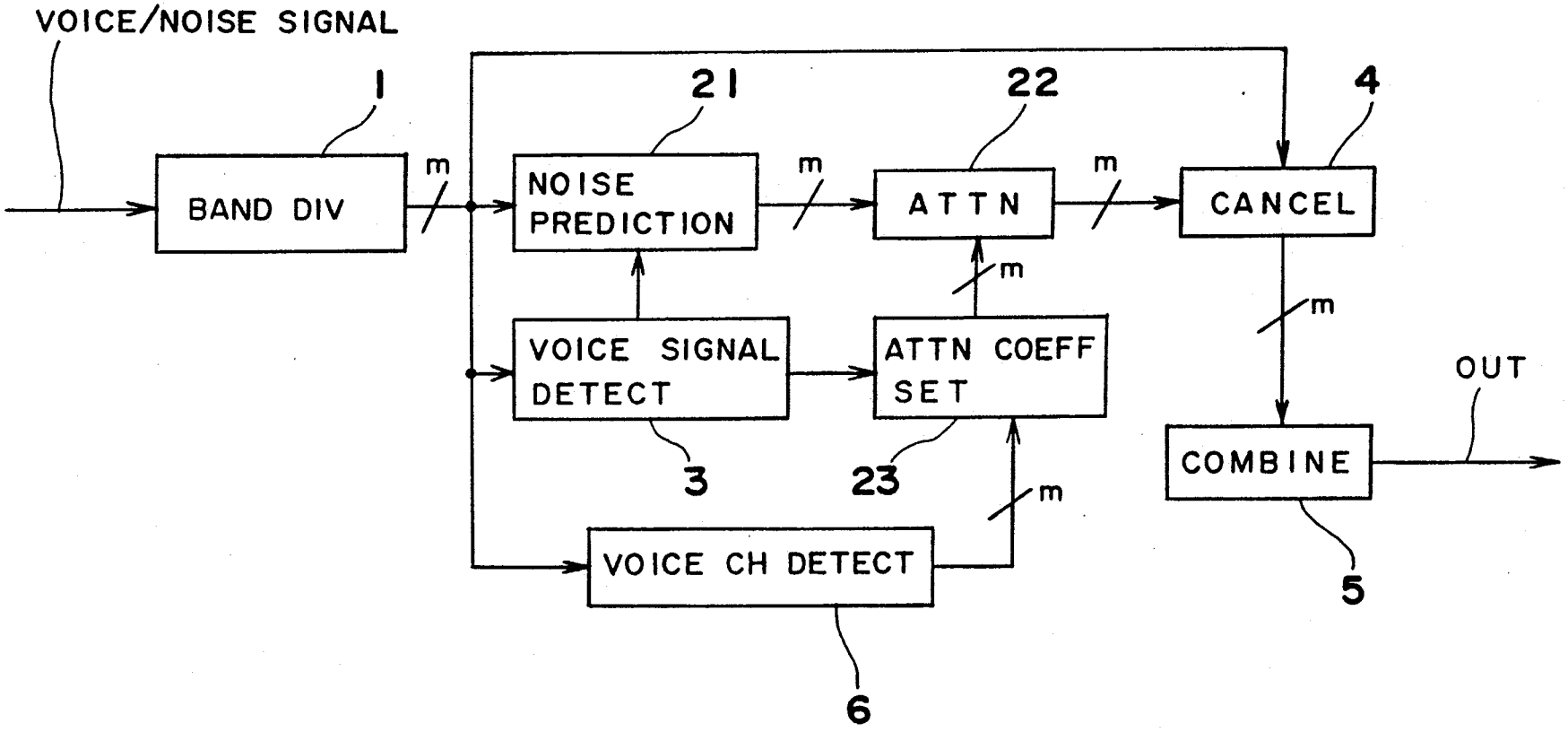
FIG. 3 is a block diagram showing another preferred embodiment of the present invention.

Referring to FIG. 3, a block diagram of another preferred embodiment of the present invention is shown. When compared with the circuit shown in FIG. 2, the circuit shown in FIG. 3 further includes a voice channel detection circuit 6 which is a circuit for detecting voice signal level in each of the signals in m-channels. In the first embodiment, the attenuation coefficient changes with time, and said change is not related to the respective voice signals in m-channels, but related to all the channels taken together. On the other hand, in the second embodiment, however, the attenuation coefficient is changed relative to each channel so as to become optimum for the level change in the voice signal in each of the m-channels. For example, for a channel with a small level of voice signal, the attenuation coefficient is set small so as to obtain a large output noise predict value and thus to cancel noise sufficiently from the signal, and for a channel with a high level of voice signal, the attenuation coefficient is increased so as to obtain a small output noise predict value and thus to not cancel noise very much from the signal. Other circuits are similar to those of foregoing embodiment.

Figure 4:
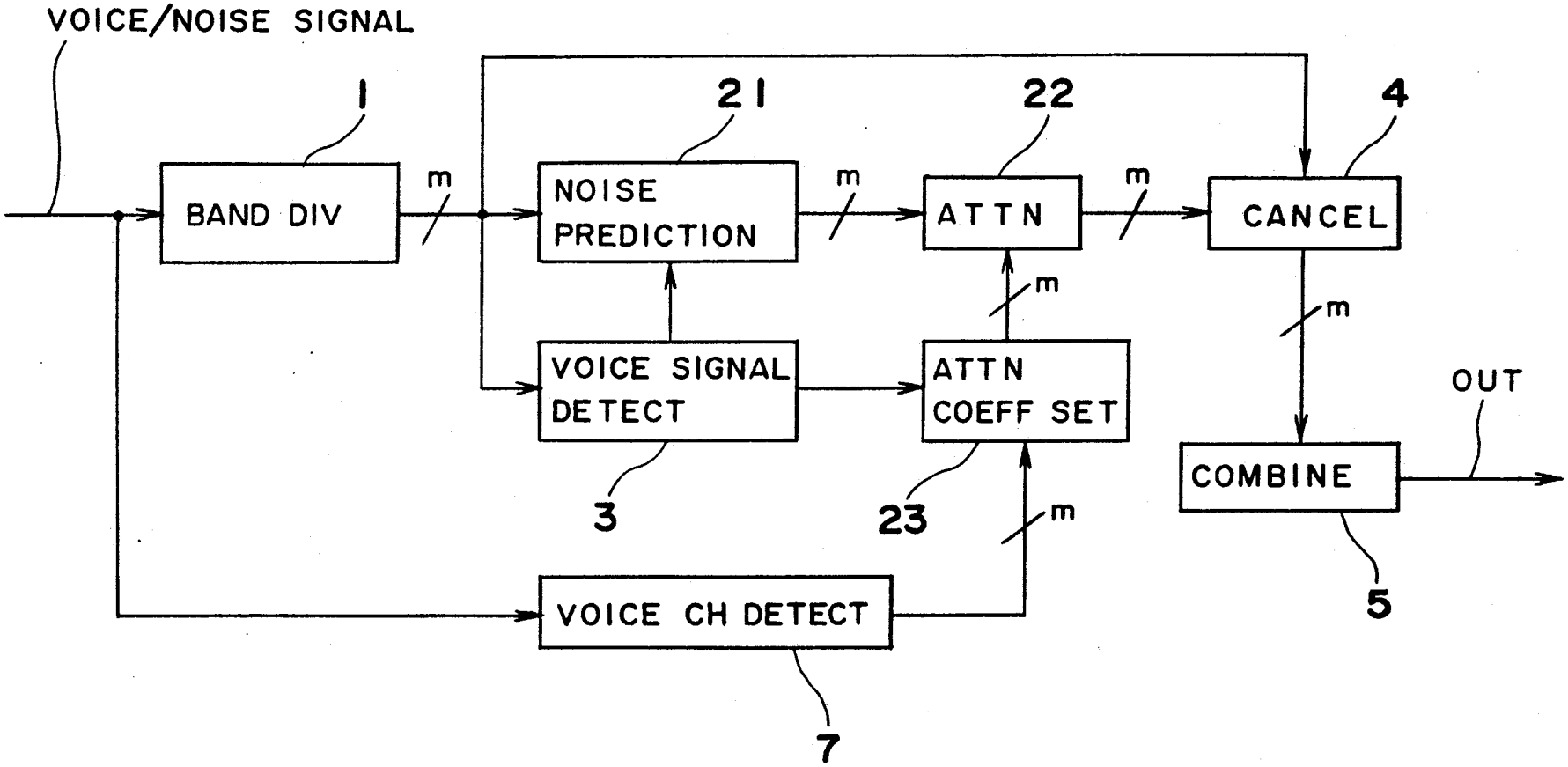
FIG. 4 is a block diagram showing a further preferred embodiment of the present invention.

Referring to FIG. 4, a block diagram of a modification of the second embodiment is shown. The circuit of FIG. 4 differs from the circuit of FIG. 3 in the voice channel detector. The voice channel detector 6 provided in the circuit of FIG. 3 is connected so as to receive the input signal from band dividing circuit 1, but the voice channel detector 7 shown in FIG. 4 is connected so as to receive the input signal from the line carrying the noise mixed voice input signal, i.e., before the band dividing circuit 1.

Therefore, the voice channel detector 7 has a circuit for detecting the voice signal level in different channels. Such a detecting circuit is formed by a known method, such as the self-correlation method, LPC analysis method, PACOR analysis method or the like.

According to the PAROR analysis method, it is possible to extract frequency characteristics of the input sound and the spectrum envelope. This can be achieved by the Durbin method, lattice circuit, modified lattice circuit, or the Le Roux method, for example. With the use of the frequency characteristics of the input sound and the spectrum envelope, it is possible to obtain the voice levels in different channels relative to the number of channels to be divided. Since PACOR analysis, LPC analysis and the self-correlation method are effected by a calculation relative to time, the channel division can be carried out for any desired channels.

Furthermore, the second embodiment shown in FIG. 3 may be further modified such that the input of the voice channel detector 6 is connected so as to receive input from the voice signal detector 3.

Next, an example of the voice signal detector 3 is described in detail.

Figure 5:
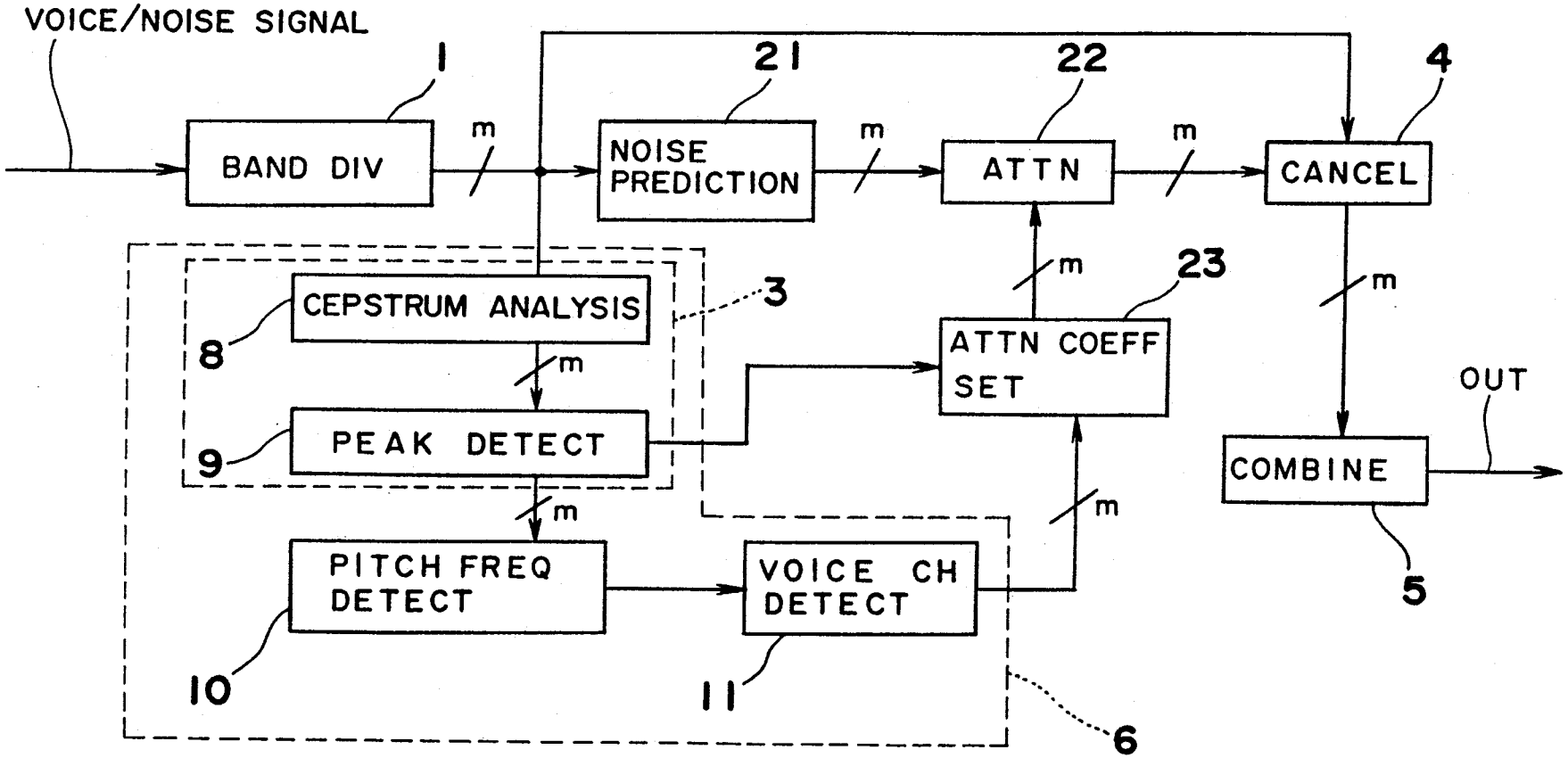
FIG. 5 is a block diagram showing a yet further preferred embodiment of the present invention.

Referring to FIG. 5, the voice signal detector 3 includes a cepstrum analysis circuit 8 for effecting cepstrum analysis of the signal subjected to a Fourier transformation by a band dividing circuit 1, and a peak detection circuit 9 for detecting the peak (P) of the cepstrum obtained by CEPSTRUM analysis circuit 8 so as to separate the voice signal from the noise signal. Thus, the voice signal portion and a channel(s) carrying such a voice signal portion are detected by utilizing a cepstrum analysis method.

Figure 10A:
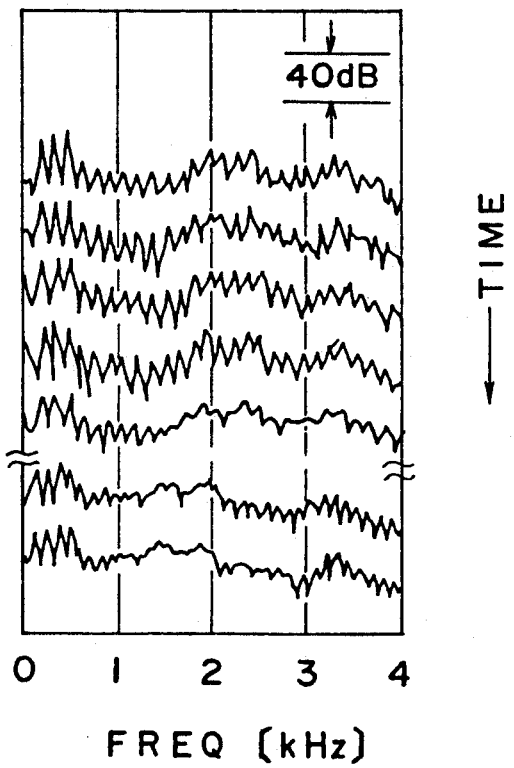
FIGS. 10*a* and 10*b* show graphs illustrating the general cepstrum analysis.
Figure 10B:
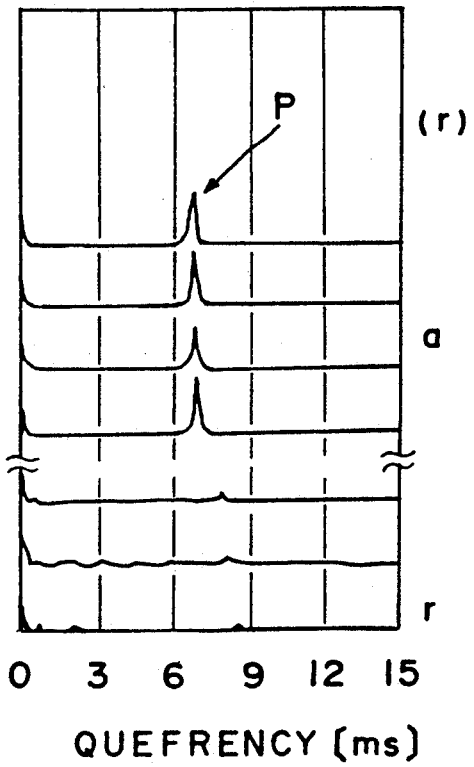

Here, the cepstrum is an inverse Fourier transformation for the logarithm of a short time amplitude of a waveform, as shown in FIGS. 10*a* and 10*b*, in which FIG. 10*a* shows a short time spectrum, and FIG. 10*b* shows a cepstrum thereof.

The point where the peak is present as detected by the peak detection circuit 9 is the voice signal portion. The detection of the peak is effected by comparison with a predetermined threshold value.

Furthermore, a pitch frequency detection circuit 10 is provided which is for obtaining the quefrency value having the peak detected by the peak detection circuit 9 from FIG. 10*b*. By Fourier transforming this quefrency value, a voice channel level detect circuit 11 detects the voice levels in respective channels. The cepstrum analysis circuit 8, peak detection circuit 9, pitch frequency detection circuit 10, and voice channel level detect circuit 11 constitute the voice channel detection circuit 6, and the cepstrum analysis circuit 8 and peak detection circuit 9 constitute the voice signal detection circuit 3.

Figure 11:
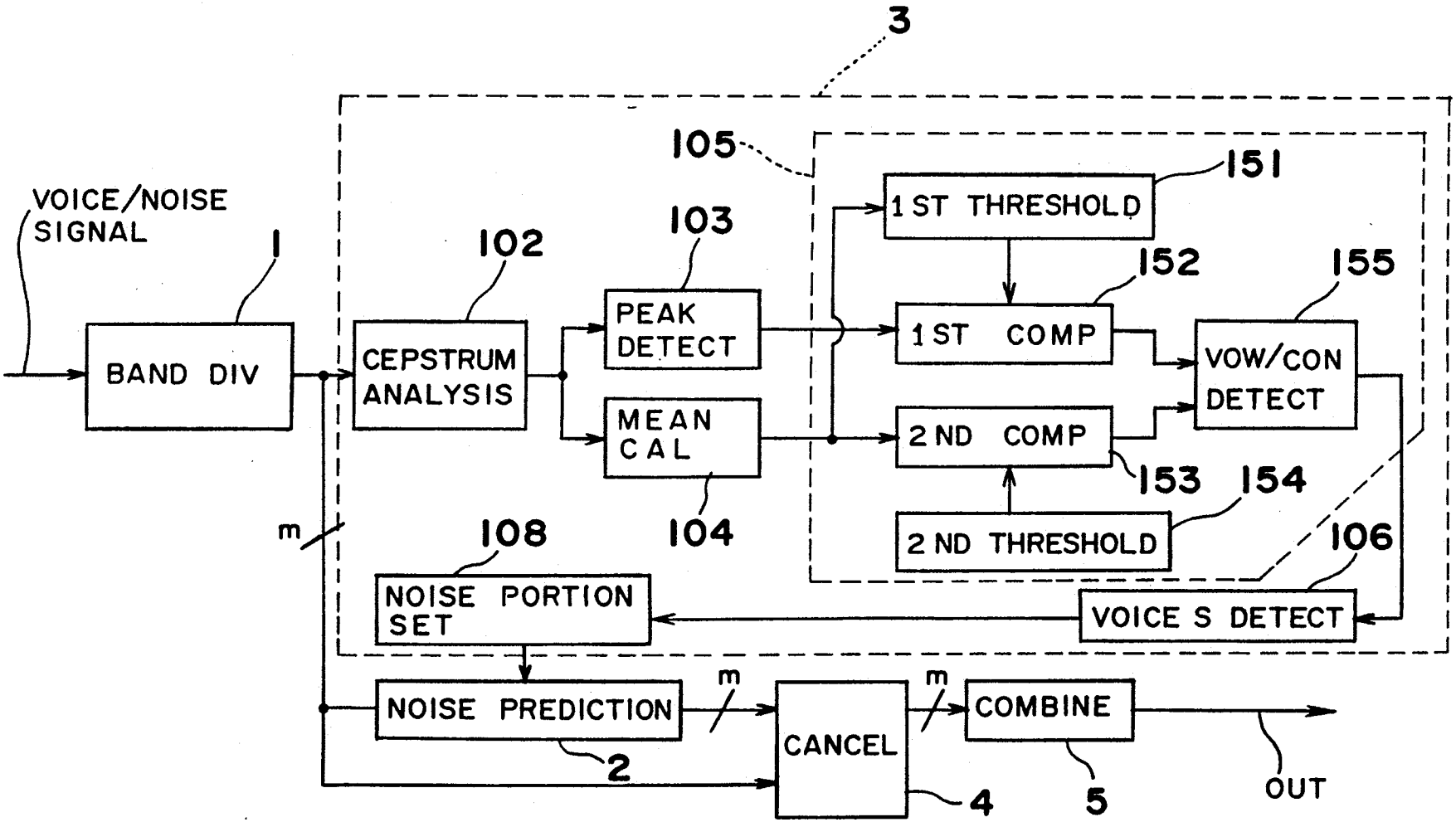
FIG. 11 is a block diagram showing another preferred embodiment of present invention.

Referring to FIG. 11, a further detail of the voice signal detector 3 is shown. In FIG. 11, the voice signal detector 3 comprises a cepstrum analysis circuit 102 for effecting the cepstrum analysis, a peak detection circuit 103 for detecting the peak of the cepstrum distribution, a mean value calculation circuit 104 for calculating the mean value of the cepstrum distribution, a vowel/consonant detection circuit 105 for detecting vowels and consonants, a voice signal detection circuit 106 for detecting the voice signal based on the detected vowel portions and consonants portions, and a noise portion setting circuit 108 for setting a portion wherein only the noise signal is present.

Figure 12A:
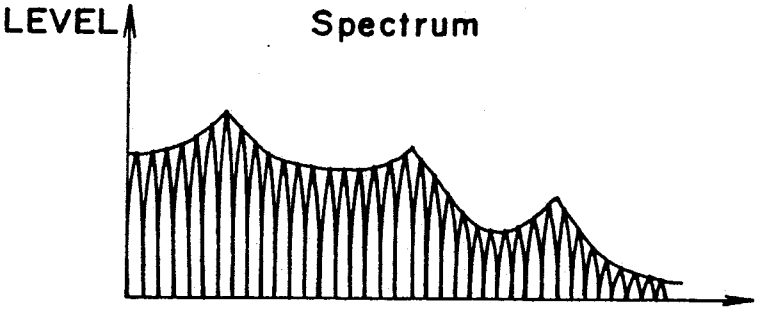
FIGS. 12*a* and 12*b* are graphs showing the cepstrum peak in the present invention.
Figure 12B:
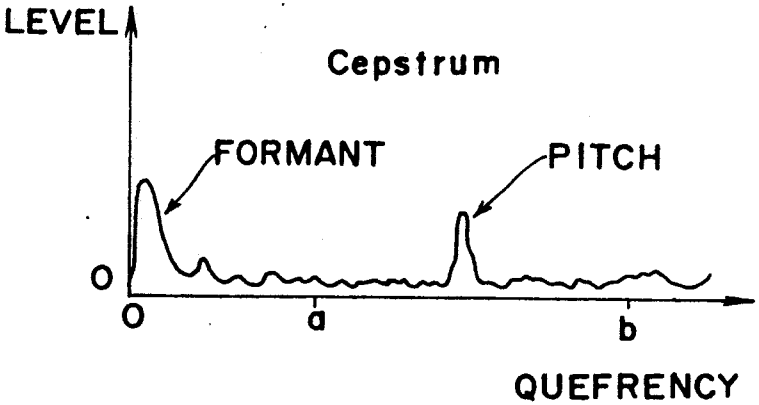

By the band dividing circuit 1, a high speed Fourier transformation is carried out for effecting the band division with respect to the input signal, and the band divided signals are applied to the cepstrum analysis circuit 102 for effecting the cepstrum analysis. The cepstrum analysis circuit 2 obtains the cepstrum with respect to said spectrum signal and supplies the cepstrum to the peak detection circuit 103 and the mean value calculation circuit 104, as shown in FIGS. 12*a* and 12*b*.

The peak detection circuit 103 obtains the peak with respect to the cepstrum obtained by the cepstrum analysis circuit circuit and supplies and peak to the vowel/consonant detection circuit 105.

On the other hand, the mean value calculation circuit 104 calculates the mean value of the cepstrums obtained by the cepstrum analysis circuit and supplies the mean value to the vowel/consonant detection circuit 105. The vowel/consonant detection circuit 105 detects vowels and consonants in the voice input signal by using the peak of the cepstrums supplied from the peak detection circuit 103 and the mean value of the cepstrums supplied from the mean value calculation circuit 104 so as to output the detection result.

The voice signal detection circuit 106 detects the voice signal portion in response to detection of the vowel portions and consonants portions by the vowel/consonant detection circuit 105.

The noise portion setting circuit 108 is a circuit for setting the portion wherein only noise is present by the step of inverting the output of the voice signal detection circuit 6.

The operation of the circuit shown in FIG. 11 will be described below.

A noise mixed with a voice input signal is Fourier transformed at a high speed by FFT circuit 1, and subsequently, the cepstrums thereof are obtained by the cepstrum analysis circuit 102, and the peaks thereof are obtained by the peak detection circuit 103. Furthermore, the mean value of the cepstrums is obtained by the mean value calculation circuit 104. In the vowel/consonant detection circuit 105, when a signal indicating the detection of a peak is received from the peak detection circuit 103, the voice signal input is judged to be a vowel portion. With respect to the detection of consonants, for example, in the case where the cepstrum mean value inputted from the mean value calculation circuit 104 is larger than a predetermined threshold value, or in the case where the increment (differential coefficient) of the cepstrum mean value is larger than a predetermined threshold value, that particular voice signal input is judged to be a consonant portion. As a result, a signal indicating vowel/consonant, or a signal indicating a voice signal portion including vowels and consonants is outputted. The voice signal detection circuit 106 detects the voice signal portion based on the signal indicating vowel/consonant voice signal portion. The noise portion setting circuit 108 sets the portions other than said voice signal portion as the noise signal portions. The noise prediction circuit 7 predicts the noise level in the next sampling cycle in the above described manner. Thereafter, the noise signal is canceled in the cancellation circuit 4.

Figure 13A:
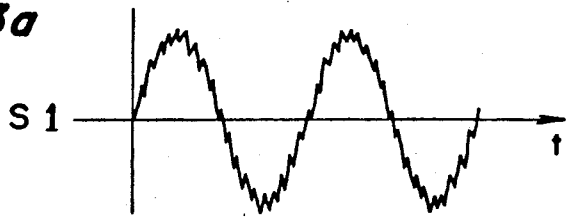
FIGS. 13*a*, 13*b* and 13*c* are waveform diagrams for explaining the cancellation method in the present invention.
Figure 13B:
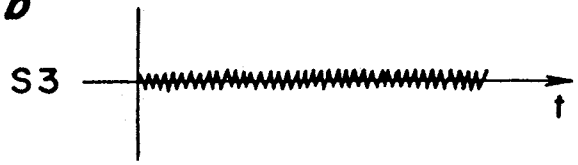
Figure 13C:
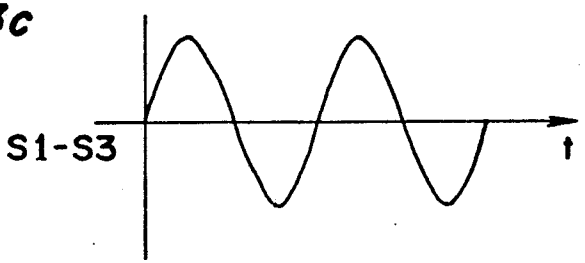

Generally, as an example of the canceling method, the cancellation on the time axis is effected, as shown in FIGS. 13*a*, 13*b* and 13*c*, by subtracting the predicted noise waveform (FIG. 13*b*) from the noise mixed voice signal input (FIG. 13*a*) so as to thereby extract the signal (FIG. 13*c*) only.

Referring to FIG. 11, the vowel/consonant detection circuit 105 includes circuits 151–154. The first comparator 152 is a circuit for comparing the peak information obtained by the peak detection circuit 103 with the predetermined threshold value set by the first threshold setting circuit 151 so as to output the result. Furthermore, the first threshold setting circuit 151 is a circuit for setting the threshold value in accordance with the mean value obtained by said mean value calculation circuit 104.

Furthermore, the second comparator 153 is circuit for comparing the predetermined threshold value set by the second threshold setting circuit 154 with the mean value obtained by said mean value calculation circuit 104 so as to output the result.

Furthermore, the vowel/consonant detection circuit 155 is a circuit for detecting whether a voice signal inputted is a vowel or a consonant based on the comparison result obtained by the second comparator 153.

The operation of the vowel/consonant detection circuit 105 will be described below.

The first threshold setting circuit 151 sets a threshold value which constitutes the base reference for determining whether a peak obtained by the peak detection circuit 103 is a peak sufficient to be determined as a vowel. In this case, the threshold value is determined with reference to the mean value obtained by the mean value calculation circuit 104. For example, in the case where the mean value is large, the threshold value is set to be high so that a peak showing a vowel may be certainly selected.

The first comparator 152 compares the threshold value set by the threshold setting circuit 151 with the peak detected by the peak detection circuit 103 so as to output the comparison result.

Meanwhile, the second threshold setting circuit 154 sets the predetermined threshold values such as the threshold value for the mean value itself or the threshold value for the differential coefficient showing the increase rate of the mean value. The second comparator 153 outputs the comparison result by comparing the mean value obtained by the mean value calculation circuit 104 with the threshold values set by the second threshold setting circuit 154. Namely, the calculated mean value and the threshold mean value are compared with each other, or the increment of the calculated mean value and the differential coefficient of the threshold value are compared with each other.

The vowel/consonant detection circuit 155 detects vowels and consonants based on the comparison result of the first comparator 152 and that of the second comparator 153. If a peak is detected in the comparison result of the first comparator 152, that particular portion is judged to be a vowel, and if the mean value exceeds the mean value of the threshold values in the comparison result of the second comparator 153, that particular portion is judged to be a consonant. Or by comparing the increment of the mean value with the differential coefficient of the threshold value, if the mean value exceeds the threshold value, that portion is judged to be a consonant.

Furthermore, as a detection method of the vowel/consonant detection circuit, it may be applicable to generate a consonant detection output by returning to the first consonant portion, only when the vowel portions and consonant portions are arranged in order in consideration of the properties of the vowel portion and consonant portion, for example, the property that the voice signal is constituted of vowel portions and consonant portions. In other words, in order to exactly distinguish consonants from noise, even in the case of detecting a consonant based on the mean value, when a consonant portion is not followed by a vowel portion, it is judged to be a noise signal.

Figure 14:
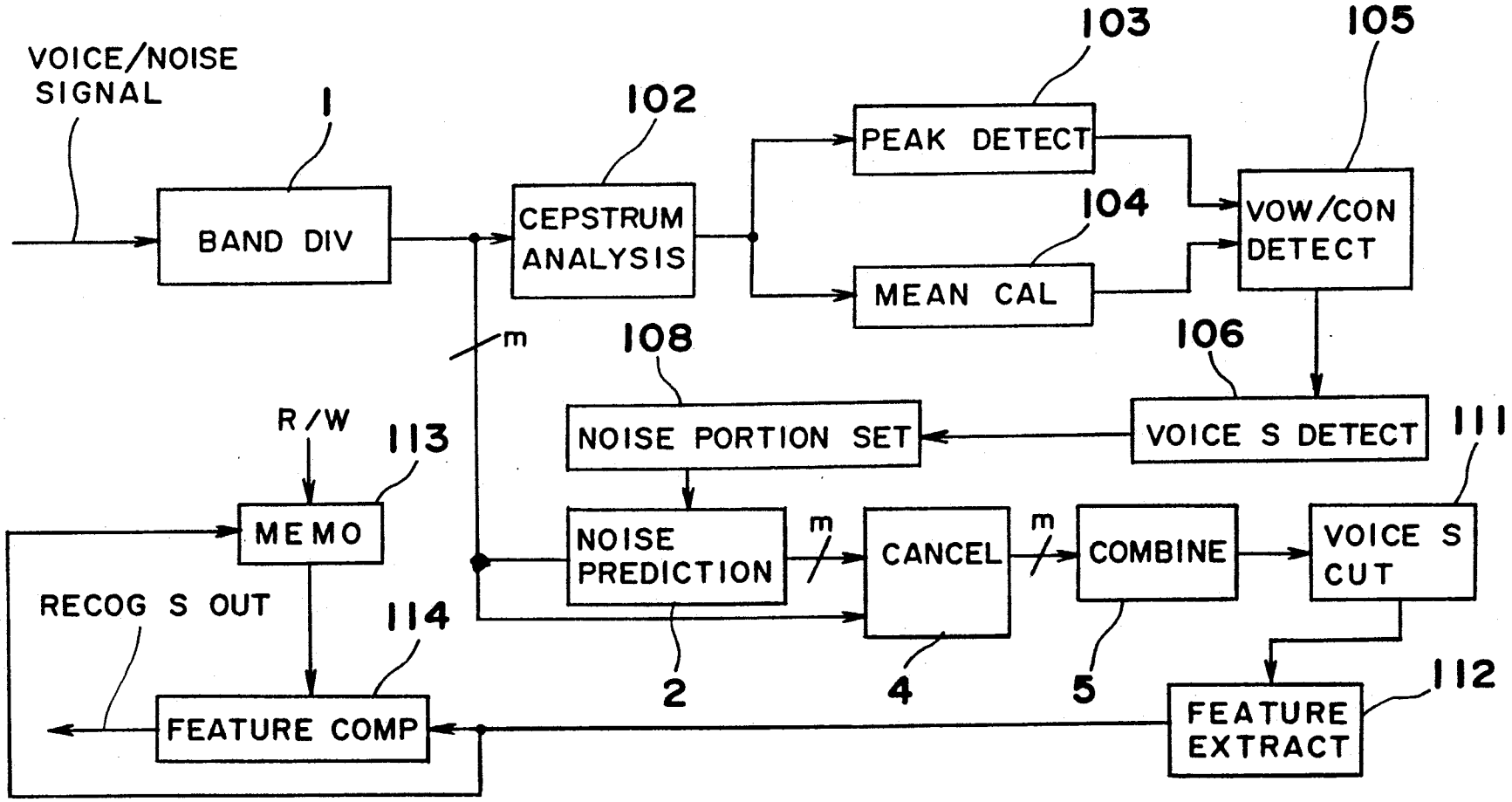
FIG. 14 is a block diagram showing a yet further embodiment of the present invention.

Referring to FIG. 14, an embodiment which effects the voice recognition by utilizing a high quality voice signal obtained by the embodiment of FIG. 11 is shown. More specifically, after the combing circuit 5, a voice signal cut-out circuit 111 for effecting cut-out for each word, each syllable such as "a", "i", "u", and each voice element is connected, and thereafter, a feature extraction circuit 112 for extracting the features of the cut-out voice syllables and the like is connected, and further thereafter, there is connected a feature comparison circuit 114 for comparing the extracted features with the reference features of the reference voice syllables stored in a memory circuit 113 so as to recognize the kind of that particular syllable. As described above, since this embodiment of the voice recognition effects the voice recognition with respect to the voice signal wherein noise signals are completely removed through the prediction thereof, the voice recognition rate becomes particularly high.

In the above-described preferred embodiments, although many circuit such as the signal detection circuit, noise prediction circuit and cancellation circuit can be realized with software by using a computer, it is also possible to only use hardware circuits having respective functions.

Furthermore, in the present invention, the term "noise signal" is used to means signals other than the signal of attention. Thus, in some cases, a voice signal may be regarded as a noise signal.

As is clear from the foregoing description, according to the present invention, since the signal portion is arranged to take a noise prediction value smaller than the noise prediction value calculated according to a predetermined noise prediction method, there is no possibility of canceling the noise to a great extent in the processing thereafter, for example, in the voice signal portion. Thus, there is no possibility of reducing the clarity of the signal because of the noise removal.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

What is claimed is:

1. A noise signal prediction system comprising:

a signal detection means for receiving a mixed signal consisting of a wanted signal and a background noise signal and for detecting the presence and absence of said wanted signal contained in said mixed signal;

a noise level detecting means for detecting an actual noise level at each sampling cycle during the absence of said wanted signal;

a storing means for storing the noise levels for a predetermined number of past sampling cycles, said storing means receiving and storing said actual noise levels during the absence of said wanted signal;

a predicting means for predicting a noise level of a next sampling cycle based on said stored noise levels in said storing means;

wherein said storing means stores said predicted noise levels during the presence of said wanted signal;

further comprising:

an attenuation means for attenuating said predicted noise level during the presence of said wanted signal, said attenuation means comprising:

an attenuation coefficient setting means for setting an attenuation coefficient to a predetermined value in response to the detection of the presence of said wanted signal; and an attenuator connected to said prediction means for attenuating the predicted noise level in accordance with said attenuation coefficient;

said noise signal prediction system further comprising a band dividing means for dividing said mixed signal into a plurality of bands of frequency ranges and for supplying said divided signals through a plurality of channels;

said signal detection means comprising:

a cepstrum analysis means for cepstrum-analyzing the signal in each channel from said band dividing means;

a peak detection means for detecting a cepstrum peak in the cepstrum analysis output of said cepstrum analysis means, whereby a wanted signal is detected as being present when a cepstrum peak is greater than a first predetermined threshold; and an average calculation means for calculating the average of the cepstrum analysis output of said cepstrum analysis means, whereby a wanted signal is detected as present when said average is greater than a second predetermined threshold; and said noise signal prediction system further comprising a vowel/consonant detection means for detecting vowels based on the peak detection information from said peak detection means and for detecting consonants based on the average information from said average value calculation means.

2. A noise signal prediction system comprising:

a signal detection means for receiving a mixed signal consisting of a wanted signal and a background noise signal and for detecting the presence and absence of said wanted signal contained in said mixed signal;

a noise level detecting means for detecting an actual noise level at each sampling cycle during the absence of said wanted signal;

a storing means for storing the noise levels for a predetermined number of past sampling cycles, said storing means receiving and storing said actual noise levels during the absence of said wanted signal;

a predicting means for predicting a noise level of a next sampling cycle based on said stored noise levels in said storing means;

wherein said storing means stores said predicted noise levels during the presence of said wanted signal;

further comprising:

an attenuation means for attenuating said predicted noise level during the presence of said wanted signal, said attenuation means comprising:

an attenuation coefficient setting means for setting an attenuation coefficient to a predetermined value in response to the detection of the presence of said wanted signal; and an attenuator connected to said prediction means for attenuating the predicted noise level in accordance with said attenuation coefficient;

said noise signal prediction system further comprising a band dividing means for dividing said mixed signal into a plurality of bands of frequency ranges and for supplying said divided signals through a plurality of channels;

said signal detection means comprising:

a cepstrum analysis means for cepstrum-analyzing the signal in each channel from said band dividing means;

a peak detection means for detecting a cepstrum peak in the cepstrum analysis output of said cepstrum analysis means, whereby a wanted signal is detected as being present when a cepstrum peak is greater than a first predetermined threshold; and an average calculation means for calculating the average of the cepstrum analysis output of said cepstrum analysis means, whereby a wanted signal is detected as present when said average is greater than a second predetermined threshold; and said peak detection means comprising a first comparator for comparing said detection cepstrum peak with said first predetermined threshold; and said average calculation means comprising a second comparator for comparing the average with said second predetermined threshold.

3. A noise signal prediction system comprising:

a signal detection means for receiving a mixed signal consisting of a wanted signal and a background noise signal and for detecting the presence and absence of said wanted signal contained in said mixed signal;

a noise level detecting means for detecting an actual noise level at each sampling cycle during the absence of said wanted signal;

a storing means for storing the noise levels for a predetermined number of past sampling cycles, said storing means receiving and storing said actual noise levels during the absence of said wanted signal;

a predicting means for predicting a noise level of a next sampling cycle based on said stored noise levels in said storing means;

wherein said storing means stores said predicted noise levels during the presence of said wanted signal;

further comprising:

an attenuation means for attenuating said predicted noise level during the presence of said wanted signal; said attenuation means comprises:

an attenuation coefficient setting means for setting an attenuation coefficient to a predetermined value in response to the detection of the presence of said wanted signal; and an attenuator connected to said prediction means for attenuating the predicted noise level in accordance with said attenuation coefficient;

said noise signal prediction system further comprising a band dividing means for dividing said mixed signal into a plurality of bands of frequency ranges and for supplying said divided signals through a plurality of channels; and further comprising a cancellation means for subtracting the predicted noise signal from said divided signal in each channel.

4. A noise signal prediction system as claimed in claim 3, further comprising a channel combining means for combining the divided signals in said plurality of channels.

* * * * *